US008662117B2

(12) United States Patent
Claborn

(10) Patent No.: US 8,662,117 B2
(45) Date of Patent: Mar. 4, 2014

(54) SECURE WEATHER CONTAINMENT SYSTEM—ENVIRO TANK

(75) Inventor: Kirk Douglas Claborn, Longview, TX (US)

(73) Assignee: EFC Valve & Controls, LLC, Ft. Worth, TX (US)

( * ) Notice: Subject to any disclaimer, the term of this patent is extended or adjusted under 35 U.S.C. 154(b) by 1002 days.

(21) Appl. No.: 12/381,717

(22) Filed: Mar. 16, 2009

(65) Prior Publication Data

US 2009/0242571 A1 Oct. 1, 2009

Related U.S. Application Data

(60) Provisional application No. 61/070,802, filed on Mar. 26, 2008.

(51) Int. Cl.
*B65D 3/12* (2006.01)
*B65B 3/12* (2006.01)

(52) U.S. Cl.
CPC ..... *B65B 3/12* (2013.01)
USPC ... 141/127; 220/23.83; 220/565; 137/565.01; 137/147; 137/312

(58) Field of Classification Search
USPC ..... 220/565, 567, 23.83, 23.87, 582, 4.12, 220/560.03, 560.1; 137/1, 565.01, 147, 137/312; 206/514; 141/86
See application file for complete search history.

(56) References Cited

U.S. PATENT DOCUMENTS

| | | | | | |
|---|---|---|---|---|---|
| 3,347,402 | A | * | 10/1967 | Forman et al. | 220/560.1 |
| 4,318,056 | A | * | 3/1982 | Sze | 372/57 |
| 4,491,147 | A | * | 1/1985 | Argandona | 137/371 |
| 4,524,609 | A | * | 6/1985 | Sharp | 73/49.2 |
| 4,655,361 | A | * | 4/1987 | Clover et al. | 137/363 |
| 4,762,440 | A | * | 8/1988 | Argandona | 405/52 |
| 4,823,829 | A | * | 4/1989 | Woods | 137/114 |
| 5,072,623 | A | * | 12/1991 | Hendershot | 73/49.2 |
| 5,284,191 | A | * | 2/1994 | McGarvey | 141/198 |
| 5,678,591 | A | * | 10/1997 | Merrifield et al. | 137/208 |
| 6,019,243 | A | | 2/2000 | Marino | |
| 6,039,123 | A | | 3/2000 | Webb | |
| 6,050,050 | A | | 4/2000 | Daul et al. | |
| 6,149,026 | A | | 11/2000 | Manson | |
| 7,165,572 | B2 | | 1/2007 | Hebblethwaite | |
| 7,231,933 | B2 | * | 6/2007 | Kim | 137/38 |
| 8,104,296 | B2 | * | 1/2012 | Harper et al. | 62/45.1 |
| 8,272,530 | B2 | * | 9/2012 | Rebernik | 220/560.05 |
| 2001/0022302 | A1 | | 9/2001 | Dunn et al. | |
| 2010/0146940 | A1 | * | 6/2010 | Goulette et al. | 60/286 |
| 2012/0285182 | A1 | * | 11/2012 | Ando | 62/55.5 |

* cited by examiner

*Primary Examiner* — Robert J Hicks
*Assistant Examiner* — Kareen Rush
(74) *Attorney, Agent, or Firm* — Sue Z. Shaper

(57) ABSTRACT

An environmentally secure weather containment system for at least one chemical container comprising a primary container significantly nested within and sealingly mated with a secondary container, the primary tank having an exposed portion, the secondary container providing a housing for at least one pump and at least one port for at least one a power line or signal line above a 110% containment level.

16 Claims, 9 Drawing Sheets

FIG.1A
(PRIOR ART)
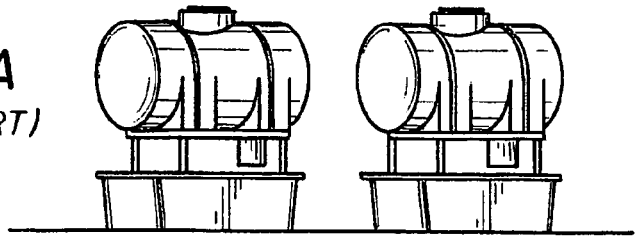
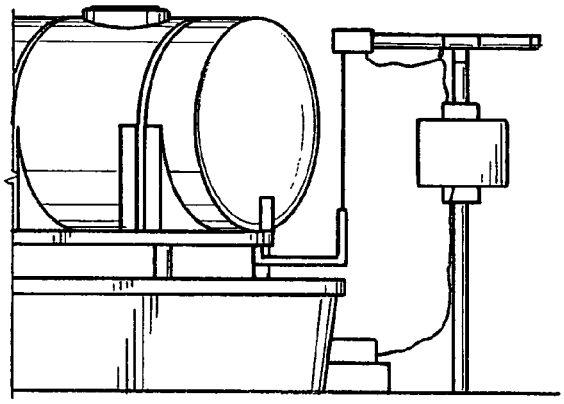
FIG.1B
(PRIOR ART)
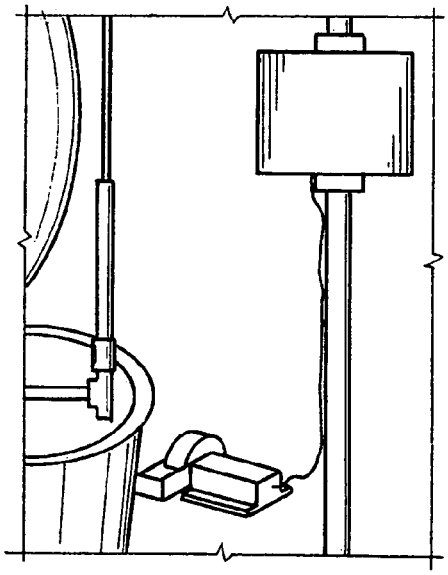
FIG.1C (PRIOR ART)
FIG.1D
(PRIOR ART)
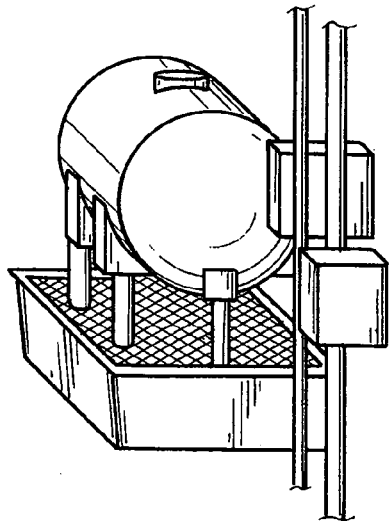

NOTE:
EXTERNAL RAIN DRIP LEDGE AND ALL-AROUND INTERNAL INTERLOCKING RAIN GROOVE ARE DESIGNED TO COMPLETELY SEAL PRIMARY CONTAINER, SECONDARY CONTAINER, AND INTERLOCKING LID FROM WEATHER ELEMENTS.

001
010
012
005
003
016
EXTERNAL RAIN DRIP LEDGE (MALE/FEMALE)

010
005
004
008

005
003
EMBOSSED LOGO 002
003
006
007

004
003
002
009
014

DETAIL A
DETAIL B
018 RAIN DRIP LEDGE ALL AROUND
017 4 STRENGTENING RIBS/LIFTING HANDLES
014 3 1" DIA. HOLES
003
017
B
A
003
EMBOSSED ENVIRO-TANK LOGO

NOTE:
EXTERNAL RAIN DRIP LIP AND 3 INTERNAL INTERLOCKING RAIN GROOVE ARE DESIGNED TO COMPLETELY SEAL PRIMARY CONTAINER, SECONDARY CONTAINER, AND INTERLOCKING LID.

FIG. 8
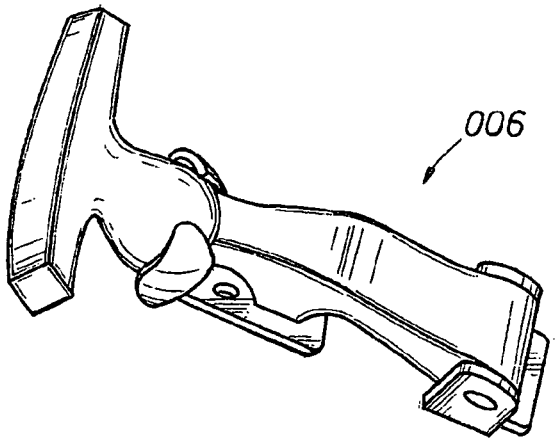
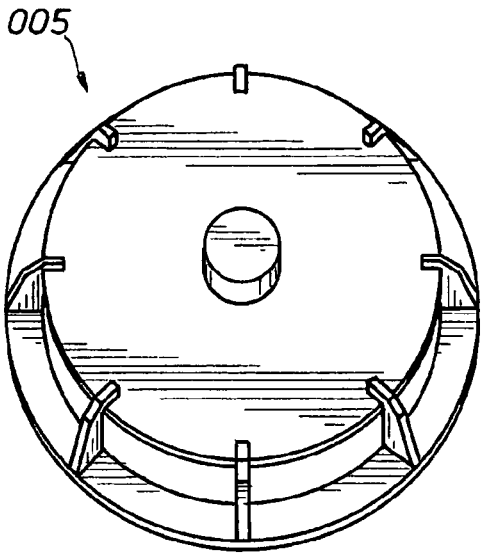
FIG. 9
FIG. 10
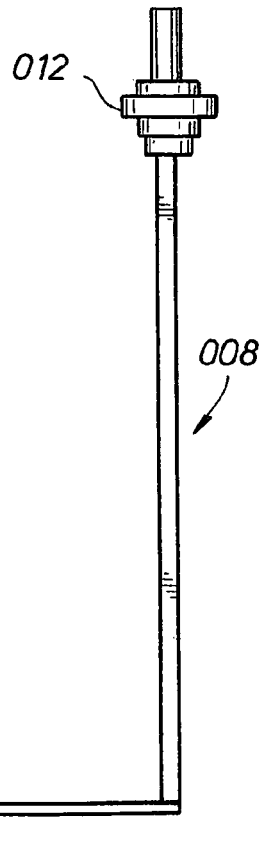
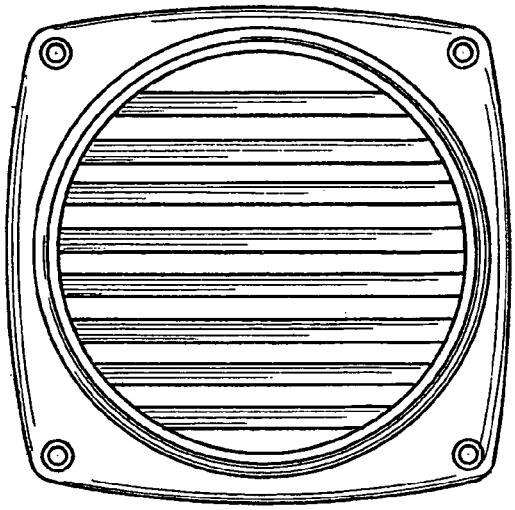
FIG. 11

SECURE WEATHER CONTAINMENT SYSTEM—ENVIRO TANK

CROSS REFERENCE TO RELATED APPLICATIONS

This application is related to, and claims priority to, Provisional Application Ser. No. 61/070,802 filed Mar. 26, 2008 entitled Secure Weather Containment System—Enviro Tank, inventor Kirk D. Claborn.

FIELD OF THE INVENTION

The invention lies in the field of secure weather containment systems for chemical tanks of approximately 25 to 500 gallon capacity, and is especially applicable for unmanned sites.

BACKGROUND OF THE INVENTION

In current practice 25 to 500 gallon chemical tanks with a pump are frequently staged at industrial sites and utilized to pump chemicals upon need. Frequently the sites are unmanned. As indicated in the "prior art" of FIGS. 1A-1D, such chemical tanks are typically supported on legs over a pan. A pump for the chemicals, as shown in the FIG. 1A, is typically located above the pan and under the tank. Gravity can at least assist the feed for the chemicals to the pump which can be electrically powered or gas powered.

The pan is provided so that any spill, as well as run-off rain that picks up chemicals leaking from orifices of the tank or pump, will be collected in the pan. Rain water is of particular concern in these circumstances as the rain that washes over the tank frequently becomes contaminated with leaking chemical. E.g. fittings installed not only on the tank but also around the pump and power lines and supply lines and gauge lines can leak at their seals.

Environmental issues are arising with these chemical tanks handled in accordance with the current practices. The issue is made more pressing when the tanks are located near urban areas and particularly when the tanks are unmanned. As mentioned above, a containment tank has fittings, such as for a chemical supply line and a sensor line, and chemicals can leak at these fittings over time. The pump can also leak chemicals at its seals. Rain washes the chemicals down into the pan, and although the potentially chemically laden rainwater that collects in the pan is in theory to be disposed of using proper procedures, unfortunately a drain in the pan may sometimes simply be pulled and the collected rainwater, contaminated or not, drained into the ground. Further, birds, animals and livestock may drink the contaminated water collected in the pan and become ill.

In particular in the oil and gas industry, and especially in regard to unmanned chemical tanks located near urban areas by such industry, the EPA is requiring tighter controls over the chemical tanks. Thus, it is desirable to improve the containment system for primary chemical tanks, in particular for tanks utilized for supporting pumping applications on pipelines, well heads, refineries and pulp and paper facilities. Most of these locations dictate unmanned operations, where an improved secondary containment system would be valuable to properly prevent all chemical spills and contamination.

One system developed in response to the animal problem mentioned above is illustrated in FIG. 1D. This system provides a porous lid (not clearly visible) over the pan. Chemically laden rain water drains through holes provided in the porous lid such that animals, livestock and birds cannot drink through the porous lid. A second alternate system proposes to minimize rainwater mixing with chemicals leaking from tank and pump seals by covering the tanks and pump with a tarp. Farm and industrial operations are known to utilize double walled tanks to contain primary tank leakage and spillage, but those systems do not address the problems of the contamination of rain water by leaks from a pumping mechanism. In sum, none of the prior art systems are totally satisfactory.

U.S. Pat. No. 6,149,026 to Manson teaches a secondary containment tank for enclosing a primary tank, and the inventor offers a remark about a possible provision for enclosing a pump. However, the containment system of Manson makes no provision for the treatment of power and chemical lines in and out of the system, especially as required by a pump, and the structure of the Manson system is unnecessarily expensive vis-à-vis the instant invention. The structure of the secondary and primary vessels of Manson are independent. Each Manson vessel provides self-sufficient, independent support. And the primary vessel has no portion exposed, for maintenance and convenience.

By contrast, the mating and nesting structure of the instant invention provides economies of construction cost and space while containing all leaks and spills from the primary container and the pump. (As "nesting" is used herein, two structures that "nest" when mated together exhibit enhanced structural strength, in excess of either structure alone.) The instant invention is comprised of at least one primary tank (preferably constructed essentially of one piece of plastic and designed to hold fluids such as petroleum products, chemicals or water solvents,) which primary tank sealingly mates with and nests within a secondary containment tank, preferably also constructed essentially of one piece of plastic, with a primary tank portion exposed. The nested construction permits economies of structure, space and cost, not possible with free-standing primary and secondary tanks. Provision is made for containing a pump, including utilizing a gravity feed.

A portion of the primary tank is exposed, preferably a primary tank lid portion. The secondary tank of the instant invention is preferably constructed to provide, in conjunction with portions of one or more primary tanks themselves, at least 110% chemical containment in the case of a primary tank rupture, as well as a containment housing for at least one pump. Fittings for lines are provided in and out of the secondary container above its 10% fluid containment level, to avoid issues of chemical leak at the secondary tank fittings and seals and thus the possible contamination of rainwater thereby.

The primary tank receives structural support and economy of space by significantly nesting within the secondary tank. In a preferred embodiment the secondary tank sealingly secures to and under a top portion of at least one primary tank. This construction permits the top or tops of the primary tank(s) to be accessible. The secondary tank is further designed to house the pumping mechanism(s), thus eliminating the risk of the contamination of rainwater by pump fittings, and preferably provides an access lid, sealingly mated to primary tank and/or the secondary tank portion.

The system of the instant invention significantly encloses at least one primary tank and pumping mechanism within a nested secondary container, protecting the surrounding environment from contamination by rainwater washing over chemicals leaking from fittings associated with either the primary tank or the associated pump as well as from spillage from a primary tank rupture. Preferably a portion of the primary tank(s) are exposed. A preferably unitary secondary tank component, together with primary tank portions, provides at least 110% containment for the primary tank fluids. Secondary tank fittings or openings are located above the 110% containment level of the primary tank liquid. In preferred embodiments rain water is inhibited from entering the secondary containment area by weather tight sealing between the secondary and primary tank(s) and the access lid.

The containment system of the instant invention is particularly useful to hold liquid for pumping applications in pipelines, well heads, refineries and pump and paper facilities. These locations are largely unmanned, and secondary containment is important to prevent chemical contamination of the environment, especially when the facilities closely interface with urban environments. Economies of material and cost and space arise with the nesting structure construction.

SUMMARY OF THE INVENTION

The invention includes a system and method for environmental containment for the chemical content of approximately 25 to 500 gallon chemical tanks and associated pumps. The system includes at least one primary tank substantially nested within a secondary tank, the secondary tank and primary tank sealingly mating against penetration by weather, with a portion of the primary tank exposed, preferably a lid portion. The secondary tank is sized to accommodate at least one pump and structured and sized in conjunction with the primary tank(s) to contain at least 110% of the primary tank(s) capacity.

BRIEF DESCRIPTION OF THE DRAWINGS

A better understanding of the present invention can be obtained when the following detailed description of the preferred embodiments are considered in conjunction with the following drawings, in which:

FIGS. 1A-1D illustrate prior art systems for protecting against chemical contamination from chemical tanks stationed at sites.

FIG. 8 illustrates a preferred embodiment of a latch for securing latching the lid to the secondary tank and the primary tank, above.

FIG. 9 illustrates a preferred embodiment of a primary tank cap, permitting access to the primary tank from the outside of the containment system.

FIG. 10 illustrates a gauge for indicating fluid level in the primary tank, the gauge visible through the top of the primary tank and containment system above.

FIG. 11 illustrates a vent for exhausting fumes from the secondary tank, above.

The drawings are primarily illustrative. It would be understood that structure may have been simplified and details omitted in order to convey certain aspects of the invention. Scale may be sacrificed to clarity.

DETAILED DESCRIPTION OF THE PREFERRED EMBODIMENTS

FIGS. 1A-1D illustrate prior art systems for protecting against chemical contamination from chemical tanks stored at sites and have been discussed above under Background of the Invention. These figures illustrate the pan system, with or without the porous lid, as discussed above.

Figure 2:
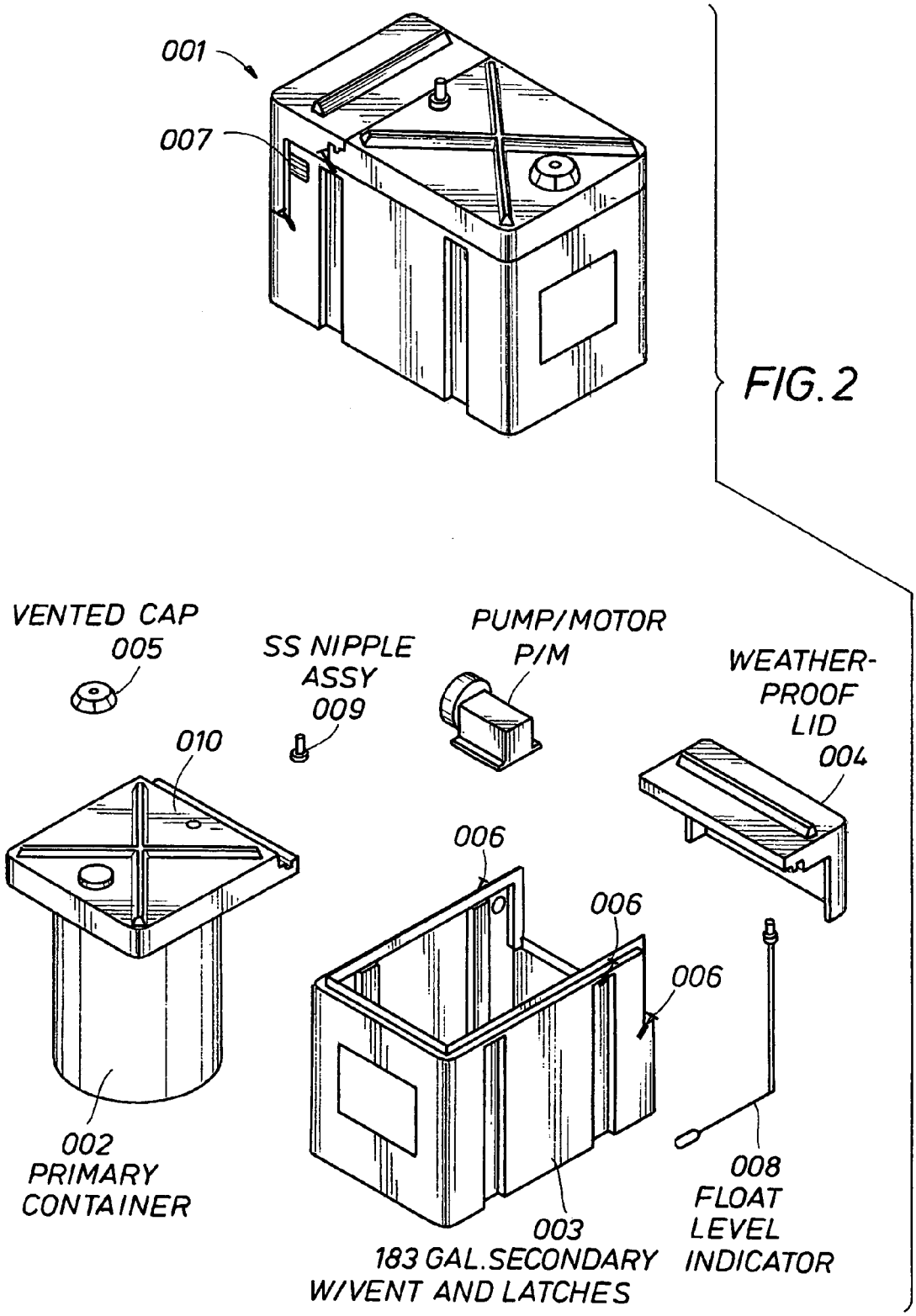
FIG. 2 illustrates a preferred embodiment of the containment system of the instant invention, in perspective and in exploded view.

FIGS. 2-12 illustrate preferred embodiments of the instant invention. As illustrated in FIG. 2, the containment system 001 is comprised of several main parts, illustrated more particularly in the exploded view. System 001 illustrates the several parts assembled. The assembled view also illustrates a louvered and screened side vent 007. The exploded view illustrates fluid level indicator 008 that inserts into primary tank 002, latch 006 for attaching the secondary container access lid 004, secondary container weather proof access lid 004, pump motor P/M which rests inside secondary container 003, primary tank nipple assembly 009 which fits into a lower side wall of primary container 002, primary tank vented cap 005 which fits securely on a top opening of the primary tank, primary tank (or container) 002, with primary tank lid portion 010 and secondary tank (or container) 003. Preferably primary container 002 is constructed of plastic in one piece, including tank body and lid, both designed to substantially nest within, and to sealingly mate with, secondary container 003, also preferably constructed of plastic in one piece.

Features of containment system 001 include an EPA friendly closed container 002 having an externally visible float level indicator and externally accessible cap. The secondary container 003 has built-in structural ribs and lift handles 017 for convenience. Edges of the secondary container are structured for weather tight seals. Grommetted access holes (FIG. 4) above the 110% content level are provided for lines into and out of the secondary container, such as for exhaust, power and supply. A louvered side screen ventilator 007 is provided to vent the secondary container.

Figures 3A, 3B, 3C, 3D, 3E:
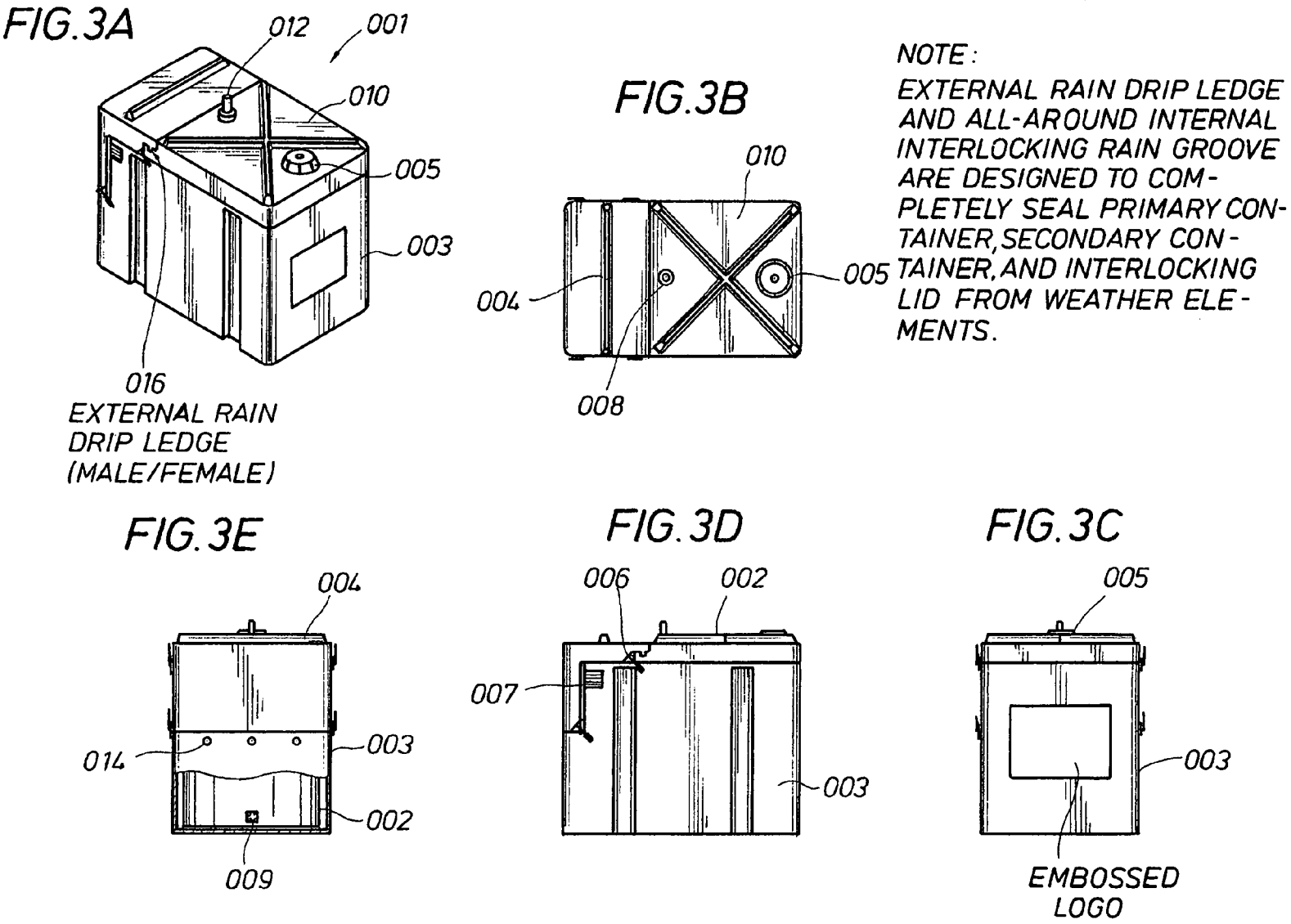
FIG. 3 illustrates the containment system above including in particular the primary tank, the secondary tank and a nesting structure.

FIGS. 3 (A-E) offer further perspective, plan and cut-away views of the preferred embodiment of the secure weather containment system 001. FIG. 3A illustrates how a top portion 012 of a float gauge assembly 008 protrudes through and is anchored onto an exposed top or lid portion 010 of a primary tank 002. FIG. 3E, in a cut-away portion of FIG. 3A, illustrates where nipple 009 is attached to a lower body wall of interior primary tank 002. In the preferred embodiment illustrated in FIGS. 3A-E, a 110% containment level will fall below the level of the grommets 014 of FIG. 3E. The secondary container 003 provides, in combination with primary container 002, 110% containment of the fluid contained within primary container(s) 002. Economies of scale, size, cost and construction are achieved by providing a sealingly mating, nested construction of primary container 002 to and with secondary container 003. Structural strengths of the nested assembly exceeds the structural strength of either container above. It is further preferable that a unitary secondary containment element provide, together with the primary tank, 110% containment. FIG. 3E also illustrates three grommet access holes 014, located above a 110% containment level of the secondary tank, and the use of four latches 006, also FIG. 3D, to securely affix access lid 004, also FIG. 3B, to portions of both secondary container 003 and primary container 002. The location of vented cap 005, on a top portion of primary tank 002 and exposed to the environment is also indicated in FIGS. 3A and 3B. In the interactive design between the secondary container, the primary container and the access lid, external rain drip ledges and all-around internal interlocking rain grooves are designed to completely seal the primary container, secondary container and interlocking access lid from penetration by the weather, when mated and latched in place. FIG. 3D illustrates placement of a louvered and secured side vent 007 on the secondary container 003. FIG. 3C also illustrates a female threaded cap 005 sealing against the primary container interior against weather elements. FIG. 3A also illustrates a male groove 015 mating with a female external rain drip ledge 016.

Figure 4:
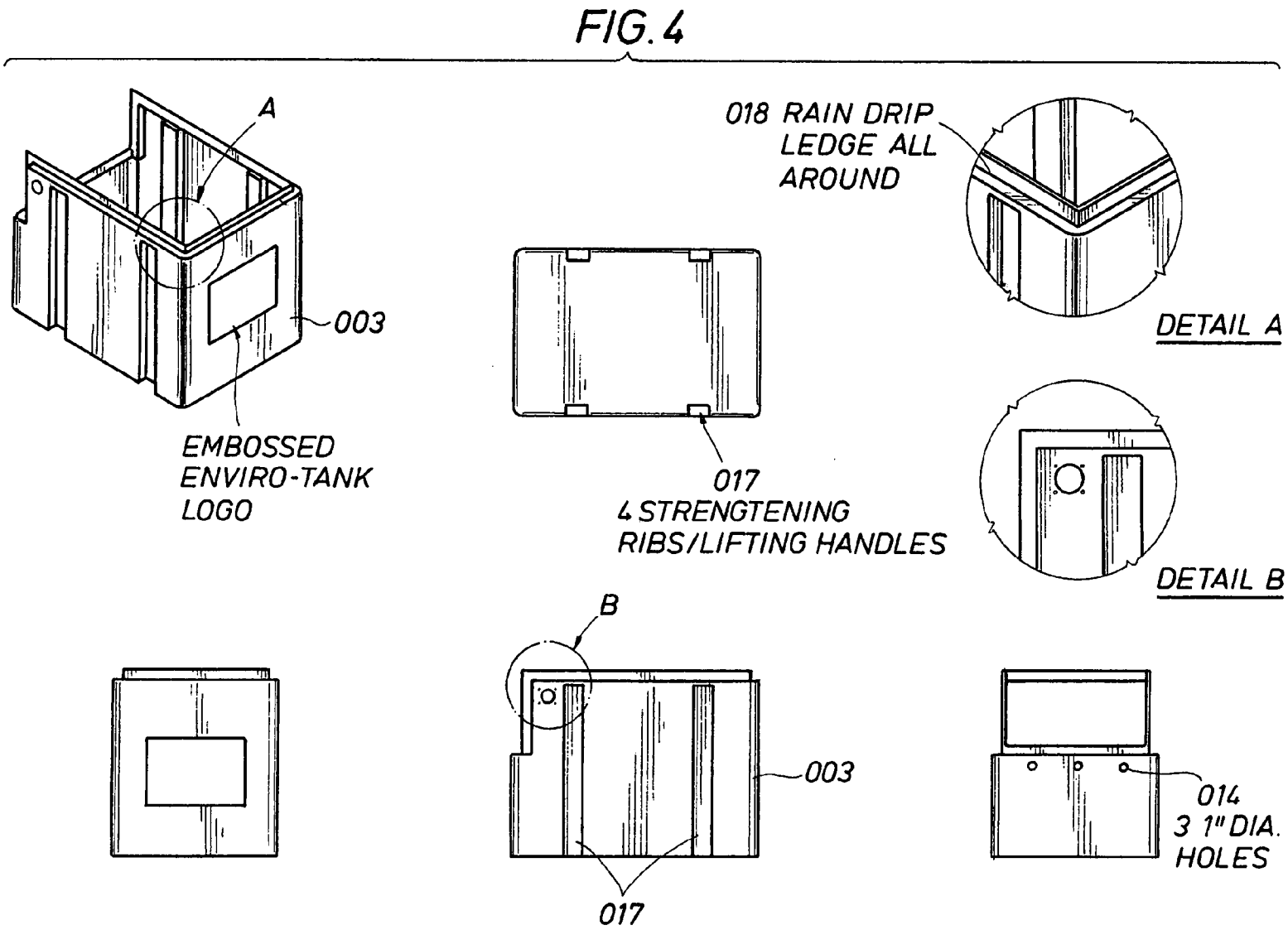
FIG. 4 illustrates in greater detail the primary unit of the secondary tank, above.

FIG. 4 illustrates in more detail features of the secondary container 003 preferably made of plastic. The structure of the side of the secondary tank preferably provides strengthening ribs and lifting handles 017. The secondary tank contains a rain drip ledge 018 around its upper periphery. Again, a location for three access holes, for grommets, 014 is indicated on an upper side wall of the secondary tank, above a 110% containment level. The external rain drip ledge 018 and interlocking rain grooves 019 are designed to assist completely sealing the primary container, the secondary container and interlocking lid from penetration by weather elements.

Figure 5:
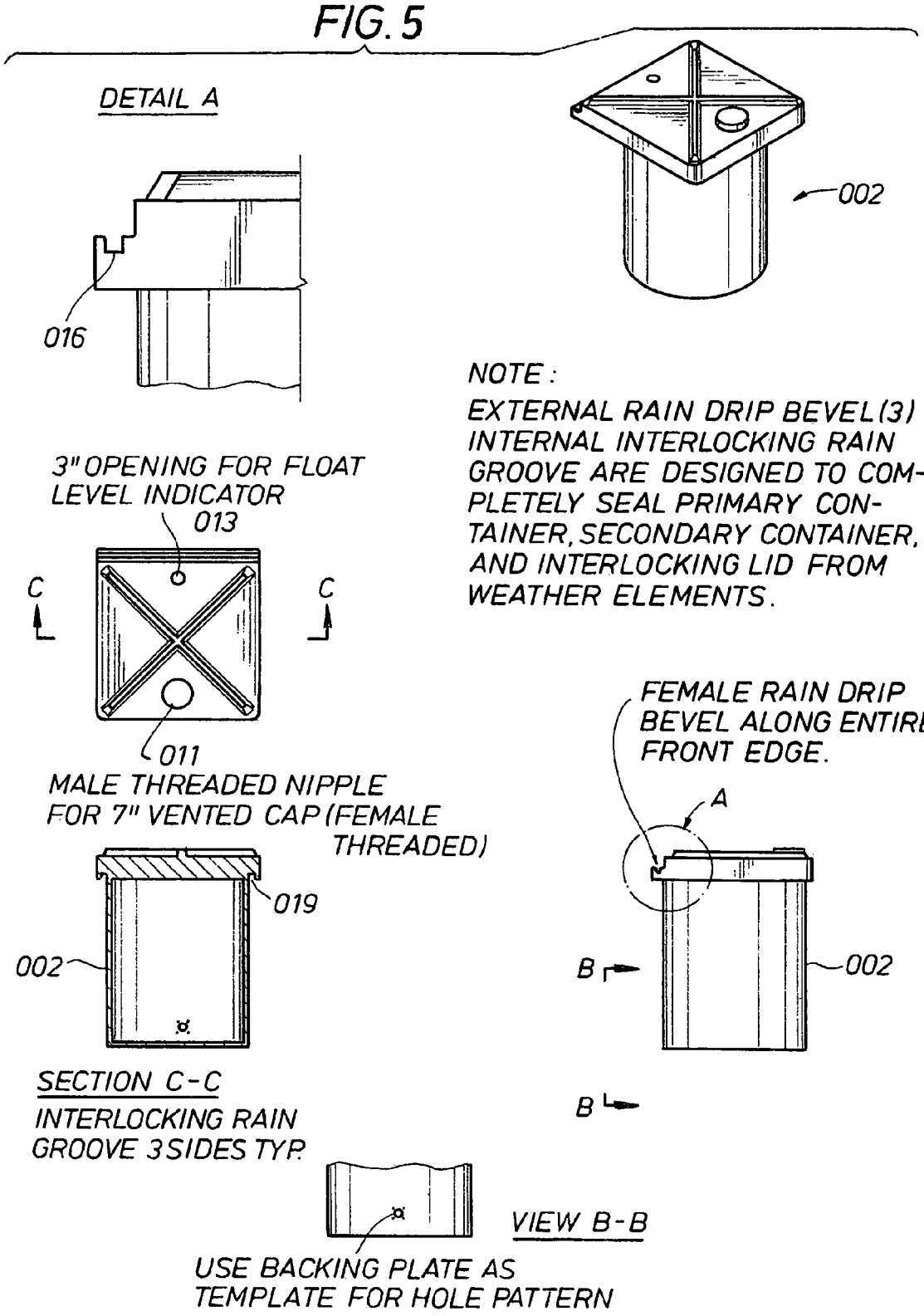
FIG. 5 illustrates in greater detail the primary tank above, designed to nest within the secondary tank.

FIG. 5 further illustrates a preferred embodiment of the construction of a primary tank 002 designed and structured to sealingly mate with, and substantially nest within, a secondary container 003. Preferably the primary tank or container, including lid portion 010, is constructed of one piece out of plastic. The primary tank is shown with a cylindrical tank section topped with a square top portion, all constructed of one piece, the top having reinforcing top ribs and opening 013 for a float gauge and a threaded opening 011 for access cap 005. Three sides of the tank lid provide for sealingly mating with upper periphery portions of the secondary container. A fourth side of the primary tank lid provides for sealingly mating with the access lid 004. The primary tank preferably contains a three inch opening on top for attaching a float level indicator and an opening for attaching a 7-inch vented cap, female threaded. Edges of the primary tank top lid, designed for mating with the access lid, contain a female rain drip bevel along the entire front edge. Again, an external rain drip bevel and three internal interlocking rain grooves are designed to completely seal the primary container, secondary container and interlocking access lid from weather elements.

Figure 6:
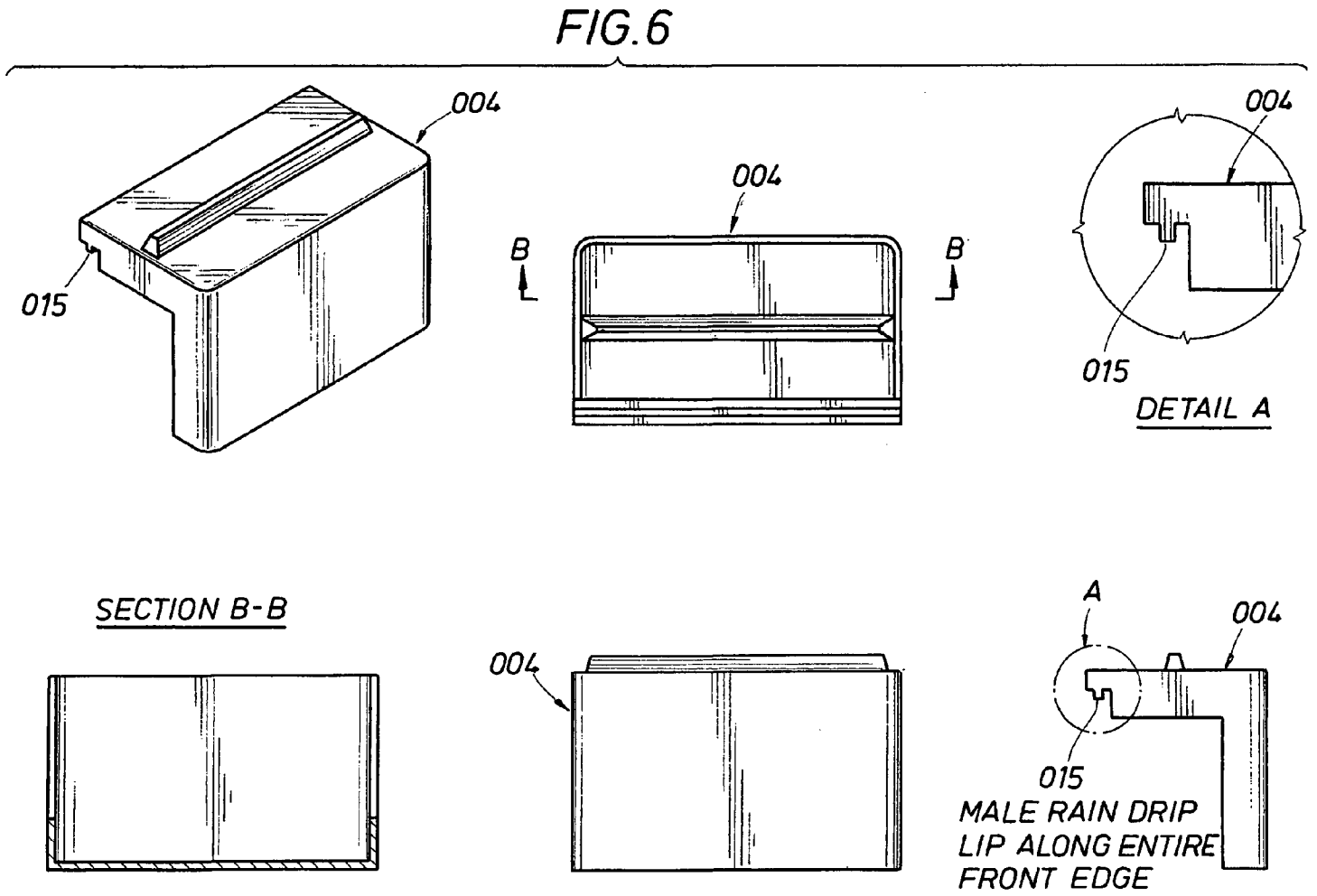
FIG. 6 illustrates a detachable lid as a portion of the secondary tank and containment system, above.

FIG. 6 illustrates a preferred embodiment of a third primary element of the system, an interlocking access lid 004. The interlocking lid contains grooves for interlocking with portions of the secondary container as well as a special groove 015 for interlocking with the edge of the primary container top.

Figure 7:
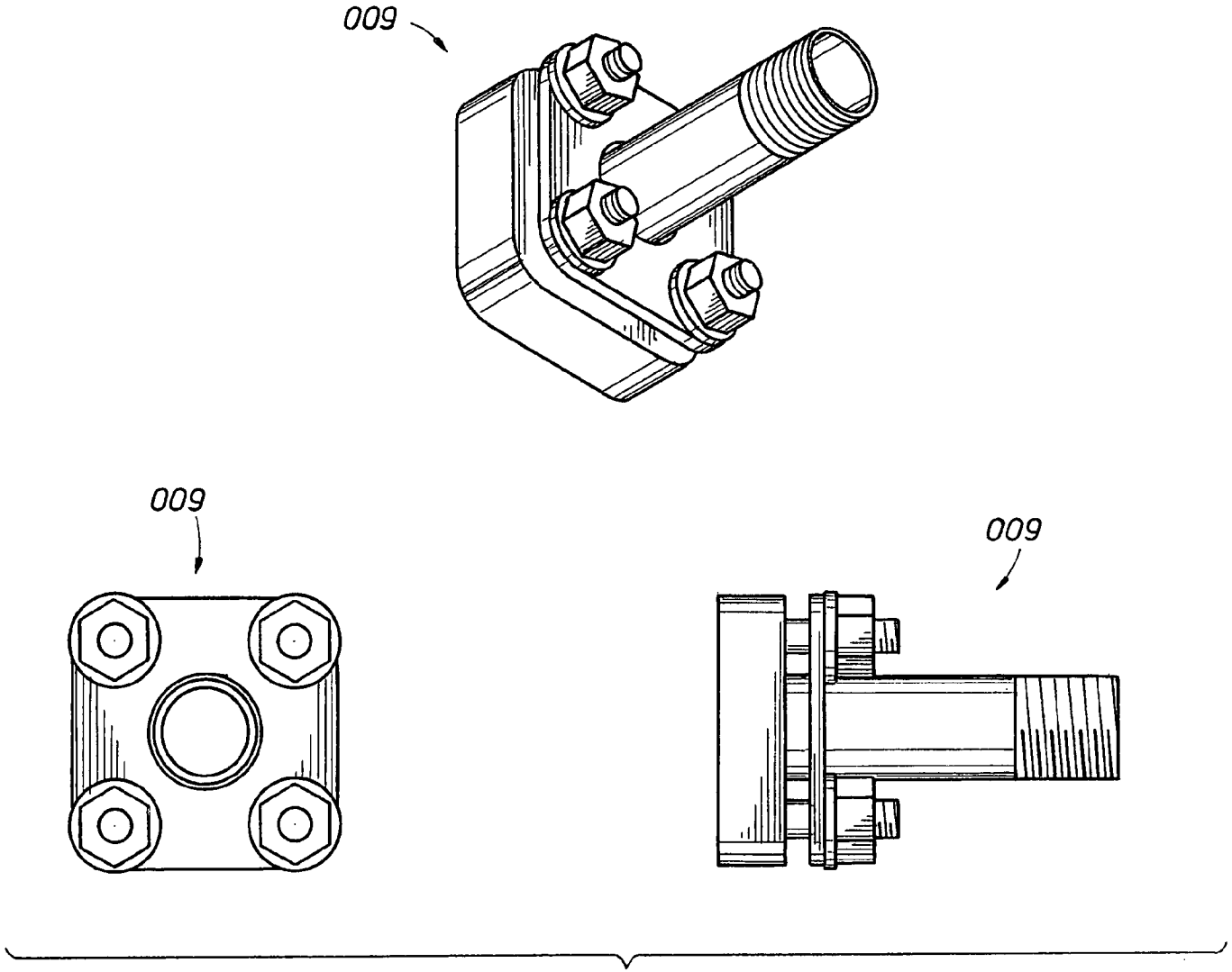
FIG. 7 illustrates a preferred embodiment of a nipple through which chemical is fed from the primary tank to the pump.

The nipple 009 illustrated in FIG. 7 provides sealed access to the chemicals stored in the primary tank, provided for fluid communication with the pump motor P/M. In preferred embodiments the pump motor is contained within the secondary container, at one side of the primary tank. Preferably the pump motor utilizes a gravity feed for the chemicals, receiving chemicals from the primary tank through the nipple in a lower portion of the primary tank wall.

FIG. 8 illustrates a preferred embodiment of a latch 006 used to help secure mating attachment between the interlocking access lid, the primary tank and the secondary tank. Preferably four such latches would be utilized.

FIG. 9 illustrates a preferred embodiment of a vented cap 005 for the primary tank, accessible to the outside.

FIG. 10 illustrates a preferred embodiment of a float gauge 008 for utilization inside of the primary tank and for visualization of a portion of the float gauge outside of the primary tank and the containment system.

FIG. 11 illustrates a preferred embodiment of a louvered vent 007 for an upper side wall portion of the secondary container in order to exhaust unwanted vapors that might collect around the pump and between the primary and secondary container. Preferably the vent is also screened. The vent is located above the 110% containment level.

Figure 12:
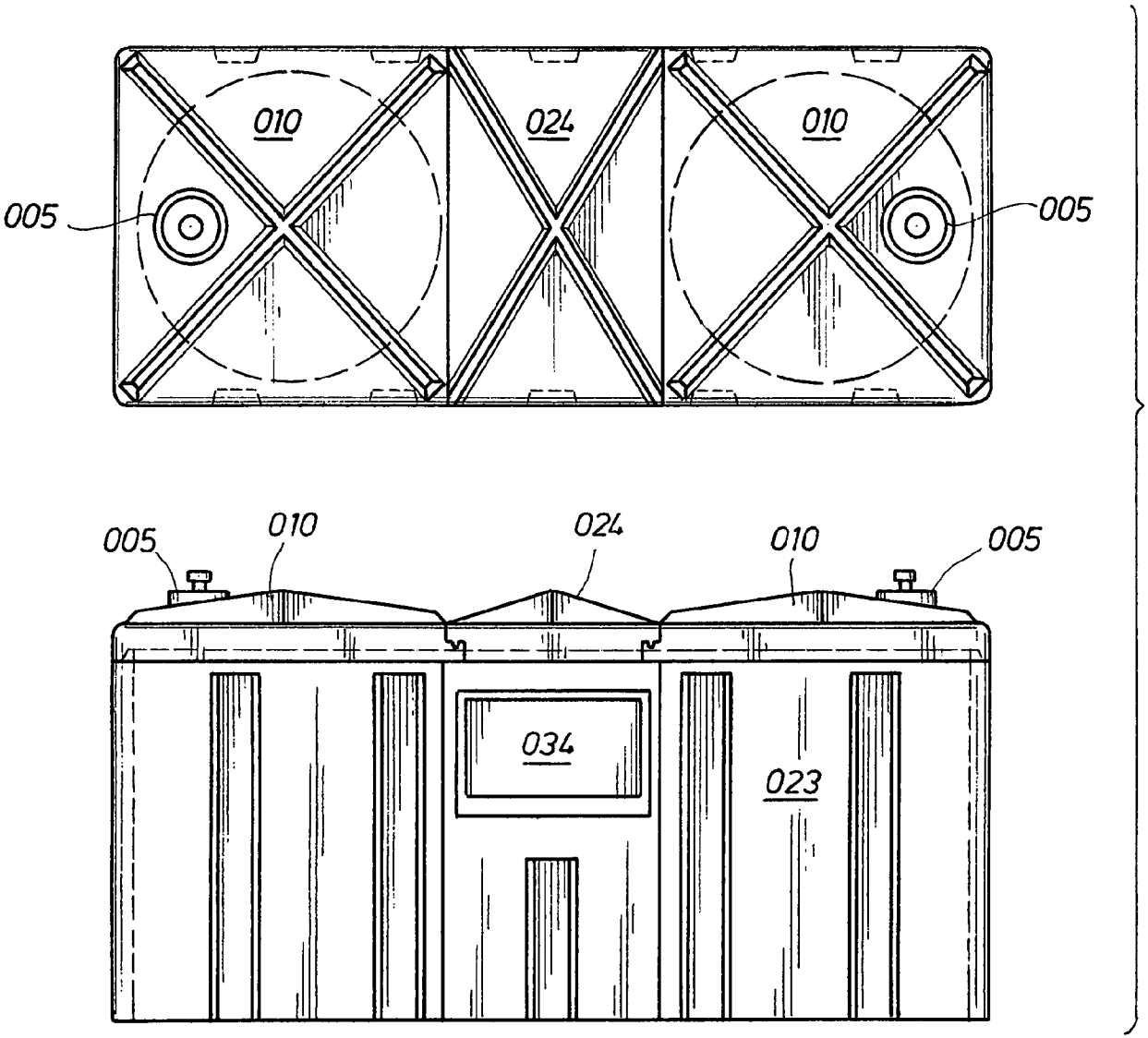
FIG. 12 illustrates a secondary container designed to house two primary containers and two pumps.

FIG. 12 illustrates an embodiment of a secondary container 023 designed to house two primary containers 002. Secondary container 023 is similar in most respects with secondary container 003, except that secondary container 023 provides for the nesting of two primary tanks 002 with lid portions 010 exposed, as illustrated in FIG. 12. Two access lids are provided, an access lid 024 analogous to access to lid 004, the access lid 024 being on top of secondary container 023. An additional access door 034 is provided recessed into the side of the secondary container 023. Access door 034 is anticipated to be hinged to the side of secondary container 023 and closed with suitable latches.

The lid portions 010 of primary containers 002 could be domed shaped for enhanced water and snow runoff. Access lid 024 on the double-sized secondary container 023 should seal with primary container lid portions 010 in an analogous manner as in the single primary tank secondary container. The weather type rain guard on secondary container 023 should be analogous to the weather type rain guard on secondary container 003. In the double secondary container 023, spaces are provided to position a single pump to run both primary tanks or to position two pumps each to run one primary tank or both pumps to pump chemicals from both tanks.

In operation primary tank 002 is placed within secondary container 003. Primary tank lid 010 sealingly mates with upper edges of secondary container 003. Primary tank 002 contains within it float gage 008. A vented cap 005 sealingly mates with an opening in lid 010. Weatherproof lid 004 is latched by means of latches 006 to sealingly mate against portions of secondary container 003 and primary container 002. Pump motor P/M has been placed inside secondary container 003. Lines connect pump motor PM with a nipple at the bottom of primary container 002. Grommet access holes 014 provide access for data, power, fluid lines and the like through secondary container 003 above the 110% containment line. With such means the pump can be operated in accordance with power and control signals and status of the pump in the tanks can be monitored through information lines. The level of fluid in the primary tank can also be visually monitored from the exterior through the float gauge 008 with the portion 012 extending through the top lid 010 of primary container 002.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. An environmental containment system for at least one approximately 25 to 500 gallon chemical tank and pump, the system comprising:

a primary tank and an associated pump connected to the primary tank for pumping chemicals out of the primary tank;

the primary tank of approximately 25 gallon to 500 gallon capacity, and structured for substantial nesting within, and sealingly mating with, a secondary tank, the sealing mating being against weather;

the primary tank having a portion exposed to weather when the primary tank and associated pump are both configured in operative containment and pumping position with the secondary tank; and the secondary tank structured and sized to accommodate the pump connected to the primary tank when configured in operative containment and pumping position and to provide, in conjunction with the primary tank, at least 110% containment of primary tank capacity.

2. An environmental containment system for at least one approximately 25 to 500 gallon chemical tank and pump, the system comprising:

at least one primary tank of approximately 25 gallon to 500 gallon capacity, structured for substantial nesting within, and sealingly mating with, a secondary tank, the sealing mating being against weather;

the primary tank having an exposed portion;

the secondary tank structured and sized to accommodate at least one pump and to provide, in conjunction with the primary tank, at least 110% containment of primary tank capacity: and wherein the primary tank contains a nipple with a gasket located along a lower a wall portion nested within the secondary tank, for connecting the primary tank to the pump.

3. The system of claims 1 or 2 that includes a secondary tank access lid structured for sealing mating, against weather, with portions of the primary and/or secondary tank system and wherein the exposed primary tank portion includes a primary tank lid portion exposed to the weather.

4. An environmental containment system for at least one approximately 25 to 500 gallon chemical tank and pump, the system comprising:

at least one primary tank of approximately 25 gallon to 500 gallon capacity, structured for substantial nesting within, and sealingly mating with a secondary tank, the scaling mating being against weather;

the primary tank having an exposed portion;

pump and to provide, in conjunction with the primary tank, at least 110% containment of primary tank capacity and wherein sealing mating structure includes use of a rain drip bevel and an interlocking rain groove.

5. The system of claim 3 including a plurality of latches for press fitting the access lid against primary and/or secondary tank portions.

6. The system of claims 1 or 2 wherein the secondary tank has at least one fitting above a 110% containment level for ingress/egress of a line.

7. The system of claim 6 wherein the at least one fitting provides system ingress/egress for at least one of a supply, power and exhaust line.

8. An environmental containment system for at least one approximately 25 to 500 gallon chemical tank and pump, the system comprising:

at least one primary tank of approximately 25 gallon to 500 gallon capacity, structured for substantial nesting within, and sealingly mating with, a secondary tank, the sealing mating being against weather;

the primary tank having an exposed portion; and the secondary tank structured and sized to accommodate, and containing, at least one pump and to provide, in conjunction with the primary tank, at least 110% containment of primary tank capacity and including a ventilation unit located in structure of the secondary tank above a 110% containment level, venting to the environment.

9. The system of claim 8 wherein the ventilation unit includes a louvered screen.

10. The system of claims 1 or 2 including a primary tank fluid level indicator, visible externally of the system.

11. The system of claim 3 wherein the primary tank lid portion includes a vented cap, externally accessible

12. A method for environmentally containing at least one approximately 25 to 500 gallon primary tank and associated connected pump for pumping chemicals out of the tank, the method comprising:

nesting at least one said primary tank of approximately 25 gallon to 500 gallon capacity within a secondary tank;

sealingly mating a portion of the primary tank with the secondary tank, against weather penetration, such that a portion of the primary tank is exposed to weather during operation, including during pumping chemicals out of the primary tank;

locating the pump connected to the primary tank within the secondary tank, sealingly protected against weather; and structuring the secondary tank of sufficient size to provide, in conjunction with the primary tank(s), at least 110% containment of primary tank capacity.

13. The method of claim 12 that includes providing fittings for ingress and egress of at least one supply line and at least one power line into the secondary container, the location of the fittings being above the level of containment of at least 110% of the primary tank(s) capacity.

14. The method of claim 12 that includes sealingly mating an access lid of the secondary tank against portions of the primary tank and/or portions of the secondary tank and wherein the exposed primary tank portion includes a lid portion.

15. The system of claims 1 or 2 including two primary tanks substantially nested within a secondary tank and two primary tank lids sealingly mating with secondary tank wall portions.

16. The system of claims 1 or 2 wherein the secondary tank is sized to accommodate two pumps.

* * * * *